US008126377B2

(12) United States Patent
Takagi et al.

(10) Patent No.: US 8,126,377 B2
(45) Date of Patent: Feb. 28, 2012

(54) DEVELOPER CARTRIDGE, DEVELOPING DEVICE, AND PROCESS CARTRIDGE

(75) Inventors: Takeyuki Takagi, Nagoya (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 750 days.

(21) Appl. No.: 12/210,334

(22) Filed: Sep. 15, 2008

(65) Prior Publication Data

US 2009/0087227 A1 Apr. 2, 2009

(30) Foreign Application Priority Data

Oct. 2, 2007 (JP) ..... 2007-258574

(51) Int. Cl.
*G03G 15/08* (2006.01)

(52) U.S. Cl. ..... 399/263; 399/256

(58) Field of Classification Search ..... 399/263, 399/254–256, 262

See application file for complete search history.

(56) References Cited

U.S. PATENT DOCUMENTS

| | | | | |
|---|---|---|---|---|
| 4,822,711 | A | 4/1989 | Itaya et al. | |
| 6,456,810 | B1 * | 9/2002 | Deguchi et al. | 399/254 |
| 7,742,726 | B2 * | 6/2010 | Mase et al. | 399/263 |
| 7,881,633 | B2 * | 2/2011 | Sakuma | 399/106 |
| 2007/0071503 | A1 * | 3/2007 | Sato | 399/258 |
| 2007/0189811 | A1 * | 8/2007 | Sato | 399/254 |
| 2007/0196135 | A1 * | 8/2007 | Fukuta | 399/254 |
| 2007/0212120 | A1 | 9/2007 | Sato | |
| 2008/0124119 | A1 * | 5/2008 | Oda | 399/120 |
| 2008/0240790 | A1 * | 10/2008 | Nishiyama et al. | 399/254 |
| 2009/0087222 | A1 * | 4/2009 | Mase et al. | 399/255 |
| 2009/0087226 | A1 * | 4/2009 | Yamazaki et al. | 399/263 |

FOREIGN PATENT DOCUMENTS

| | | | |
|---|---|---|---|
| JP | 63-127272 | A | 5/1988 |
| JP | 09-319202 | | 12/1997 |
| JP | 11-119526 | A | 4/1999 |
| JP | 2002-006598 | A | 1/2002 |
| JP | 2002-221853 | A | 8/2002 |
| JP | 2003-156927 | A | 5/2003 |

(Continued)

OTHER PUBLICATIONS

The reference Muramatsu et al. (Pub No. JP 2006-251,512 A) Pub Date Sep. 21, 2006, provided by Applicant.* JP Office Action mailed Oct. 27, 2009, JP Appln. 2007-258574, English translation.

*Primary Examiner* — David Gray
*Assistant Examiner* — Rodney Bonnette
(74) *Attorney, Agent, or Firm* — Banner & Witcoff, Ltd.

(57) ABSTRACT

A developer cartridge includes a housing for accommodating developer, a rotation shaft rotatably supported by the housing and passing across an inside of the housing. Also, the cartridge includes a supply opening formed in a wall of the housing opposite in a diameter direction of the rotation shaft, and a return opening formed in a wall of the housing at a position displaced from the supply opening in an axial direction of the rotation shaft. In addition, the cartridge includes a first agitation blade supported by the rotation shaft and passing through a position opposite the return opening along an inner surface of the housing from above to below the position opposite the return opening along with a rotation of the rotation shaft, and a second agitation blade supported by the rotation shaft and passing through a position opposite the supply opening along an inner surface of the housing.

13 Claims, 12 Drawing Sheets

FOREIGN PATENT DOCUMENTS

| | | | |
|---|---|---|---|
| JP | 2003-337466 | A | 11/2003 |
| JP | 2004-077668 | A | 3/2004 |
| JP | 2004-163822 | A | 6/2004 |
| JP | 2005-134725 | A | 5/2005 |
| JP | 2006-251512 | A | 9/2006 |
| JP | 2007-240571 | A | 9/2007 |

* cited by examiner

DEVELOPER CARTRIDGE, DEVELOPING DEVICE, AND PROCESS CARTRIDGE

CROSS-REFERENCE TO RELATED APPLICATIONS

This application claims priority from Japanese Patent Application No. 2007-258574 filed on Oct. 2, 2007, the entire subject matter of which is incorporated herein by reference.

TECHNICAL FIELD

The present invention relates to a developer cartridge having a supply opening for supplying developer in a cartridge to a developing chamber and a return opening for returning developer from the developing chamber to the inside of the cartridge, and more particularly, to a developing device having the developer cartridge and a process cartridge.

BACKGROUND

In general, an image processing apparatus such as an image forming apparatus includes a photosensitive drum having electrostatic latent images formed thereon, a process cartridge having a developing roller for supplying toner to the photosensitive drum, and a toner cartridge (developer cartridge) having toner accommodated therein. As an example of the image forming apparatus, JP-A-9-319202 discloses a configuration including a supply opening for supplying toner in a toner cartridge to a developing chamber, a toner cartridge having formed therein a return opening for returning toner from the developing chamber to the inside of the toner cartridge, an agitator having blades for agitating the interior of the toner cartridge, and an auger capable of conveying toner within the developing chamber at a supply opening side toward a return opening side. In the image forming apparatus, when the agitator is rotated, the blades of the agitator are rotated so that the blades pass through a position opposite the supply opening from the below to the above, whereby the toner accumulated in the lower half portion of the toner cartridge is pushed upward by the blades of the agitator to be delivered through the supply opening at the above and is discharged through the supply opening. The toner is then conveyed toward the return opening side by the auger and circulated in such a manner that the toner is returned back through the return opening into the toner cartridge. Therefore, fresh toner can be always supplied to the developing chamber from the cartridge.

SUMMARY

Aspects of the present invention provide a developer cartridge, a developing device, and a process cartridge capable of improving circulation of developer.

BRIEF DESCRIPTION OF THE DRAWINGS

FIGS. 5A to 5D are diagrams showing an operation of the agitator, in which FIG. 5A is a front view showing a state where an oblique agitation blade is positioned at a lower half portion of an inside housing, FIG. 5B is a front view showing a state where developer is conveyed toward a supply opening side by the oblique agitation blade, FIG. 5C is a front view showing a state where a delivery agitation blade is positioned at the lower half portion of the inside housing, and FIG. 5D is a front view showing a state where developer slips off from the delivery agitation blade and is delivered through the supply opening into the developing chamber;

FIGS. 6A to 6D are sectional views taken along the line VI-VI in FIG. 5A, in which FIG. 6A is a sectional view showing the state where the oblique agitation blade is positioned at the lower half portion of the inside housing, FIG. 6B is a sectional view showing the state where developer is conveyed toward the supply opening side by the oblique agitation blade, FIG. 6C is a sectional view showing the state where the delivery agitation blade is positioned at the lower half portion of the inside housing, and FIG. 6D is a sectional view showing the state where developer slips off from the delivery agitation blade and is delivered through the supply opening into the developing chamber;

FIGS. 7A to 7D are sectional views taken along the line VII-VII in FIG. 5A, in which FIG. 7A is a sectional view showing the state where the oblique agitation blade is positioned at the lower half portion of the inside housing, FIG. 7B is a sectional view showing the state where developer is conveyed toward the supply opening side by the oblique agitation blade, FIG. 7C is a sectional view showing the state where the delivery agitation blade is positioned at the upper half portion of the inside housing, and FIG. 7D is a sectional view showing the state where developer is returned through the return opening into the developing chamber;

FIGS. 11A and 11B are diagrams showing conveyance of developer by the delivery agitation blade, in which FIG. 11A is a sectional view showing the state the delivery agitation blade is positioned at the lower half portion of the inside housing, and FIG. 11B is a sectional view showing the state where developer is pushed through the supply opening into the developing chamber by the delivery agitation blade.

SUMMARY

<General Overview>

According to an aspect of the present invention, there is provided a developer cartridge comprising: a housing configured to accommodate developer; a rotation shaft that is rotatably supported by the housing and passes across an inside of the housing; a supply opening that is formed in a wall of the housing opposite in a diameter direction of the rotation shaft and is configured to supply the developer to an outside of the housing; a return opening that is formed in a wall of the housing at a position displaced from the supply opening in an axial direction of the rotation shaft and is configured to return the developer to the inside of the housing; a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to pass through the position opposite the return opening from an above to a below of the position opposite the return opening along with the rotation of the rotation shaft.

According to another aspect of the present invention, there is provided a developing device comprising: the developer cartridge according to the above aspect; a developing chamber to which developer is supplied through the supply opening of the developer cartridge; a supply roller provided in the developing chamber; and a developing roller to which the developer is supplied from the supply roller.

According to still another aspect of the present invention, there is provided a process cartridge comprising: the developing device according to the above aspect; and a photosensitive drum to which the developer is supplied from the developing roller.

Exemplary Embodiments

Exemplary embodiments of the invention will be described with reference to the drawings.

The above described related art apparatus has some disadvantages. For example, the agitator is rotated such that the blades of the agitator pass through the position opposite the supply opening from the below to the above. In this case, when the blades are also provided at the return opening side, the toner accumulated in the lower half portion of the cartridge is pushed upward by the return opening-side blades, and the toner is pushed through the return opening into the developing chamber. Thus, the toner may not circulate smoothly.

Aspects of the present invention provide a developer cartridge, a developing device, and a process cartridge capable of improving circulation of developer.

FIRST EXAMPLE

Figure 1:
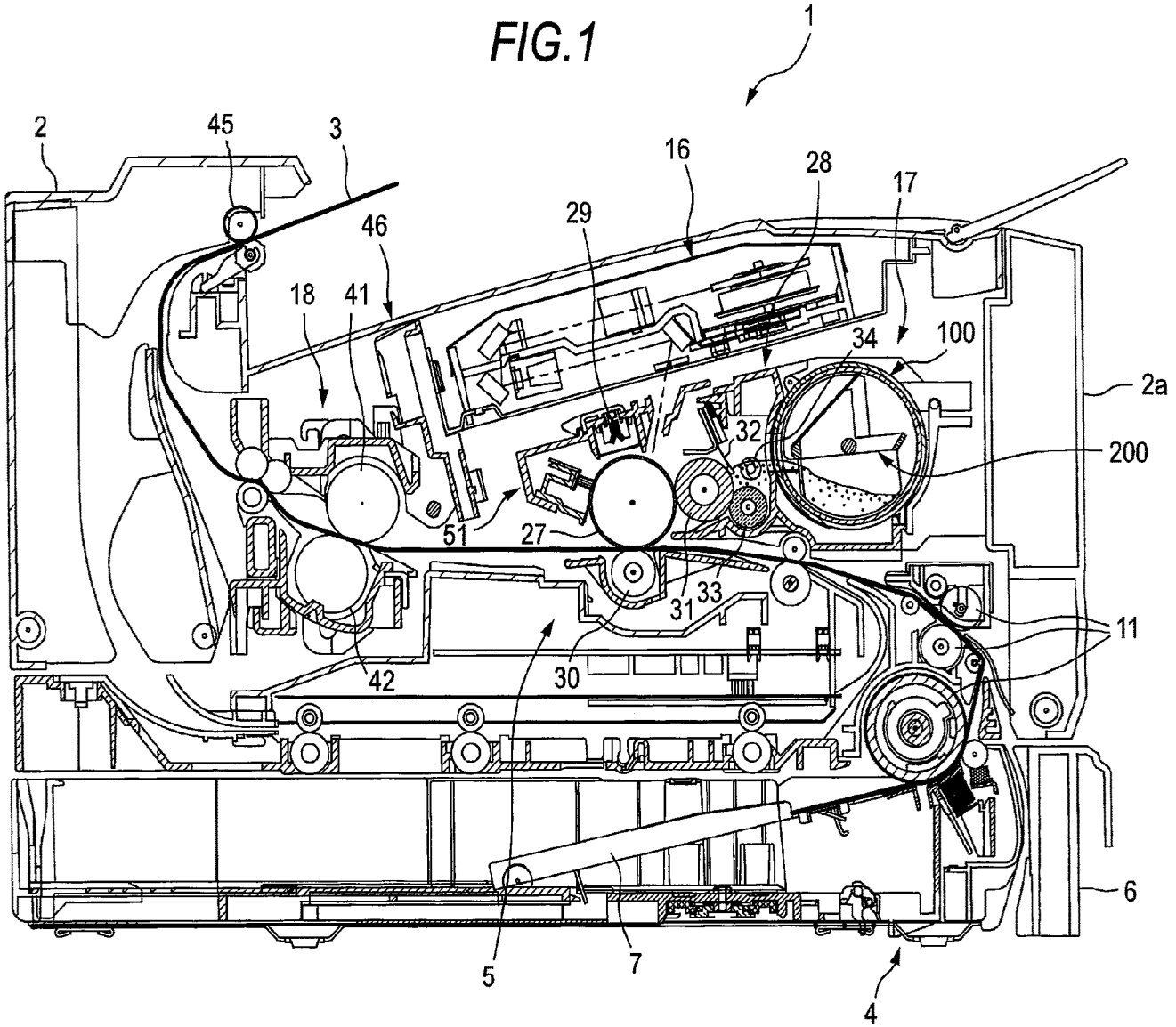
FIG. 1 is a side sectional view of an image forming apparatus according to a first example of the invention.

FIG. 1 is a side sectional view of an image forming apparatus according to a first example of the invention.

(1) Image Forming Apparatus

As shown in FIG. 1, an image forming apparatus 1 includes a body casing 2, a feeder unit 4 for conveying sheet 3, an image forming unit 5 for forming images on the sheet 3, and the like.

(2) Feeder Unit

The feeder unit 4 includes a sheet feed tray 6, a sheet pressing plate 7, and various rollers 11. In the feeder unit 4, the sheet 3 in the sheet feed tray 6 is moved upward by the sheet pressing plate 7 and conveyed to an image forming unit 5 by the various rollers 11.

(3) Image Forming Unit

The image forming unit 5 includes a scanner unit 16 as an example of an exposure unit, a process cartridge 17, a fixing unit 18, and the like.

(4) Scanner Unit

The scanner unit 16 includes a laser emitting part (not shown), a polygon mirror, lenses, and a reflection mirror (not denoted by reference numeral). In the scanner unit 16, a laser beam travels along a path indicated by a chain line in the drawing and is scanned and irradiated onto the surface of a photosensitive drum 27 of the process cartridge 17.

(5) Process Cartridge

The process cartridge 17 is detachably attached to the body casing 2 by opening a front cover 2*a*. The process cartridge 17 includes a developing cartridge 28 as an example of a developing device, and a drum unit 51, etc.

The developing cartridge 28 is configured to be detachable from the body casing 2 in a state where it is attached to the drum unit 51. The developing cartridge 28 may be configured to be detachable from the drum unit 51 that is fixed to the body casing 2.

The developing cartridge 28 includes a developing roller 31, a thickness regulation blade 32, a supply roller 33, and an auger 34. A developer cartridge 100 (which will be described later) is detachably attached to the developing cartridge 28. The developer in the developer cartridge 100 is agitated by an agitator 200 and is supplied to the developing roller 31 by the supply roller 33. At this time, the developer is positively charged by friction while being rubbed between the supply roller 33 and developing roller 31. Subsequently, with the rotation of the developing roller 31, the developer supplied onto the developing roller 31 is moved between the thickness regulation blade 32 and the developing roller 31, where the developer is then carried as a thin layer of a predetermined thickness on the developing roller 31.

The drum unit 51 includes a photosensitive drum 27, a scorotron charger 29, and a transfer roller 30. In the drum unit 51, the surface of the photosensitive drum 27 is uniformly charged with positive charges by the scorotron charger 29 and is thereafter exposed by the laser beam fast-scanned from the scanner unit 16. With this exposure, the electric potential at the exposed portion decreases and thus electrostatic latent images based on image data are formed on the exposed portion. Here, the term, "electrostatic latent images," refers to an exposed portion which is exposed by the laser beam and the electric potential of which is decreased, among portions on the surface of the photosensitive drum 27 which is uniformly charged with positive charges. Next, when the developer carried on the surface of the developing roller 31 is brought into opposing contact with the photosensitive drum 27 by the rotation of the developing roller 31, the developer carried on the surface of the developing roller 31 is supplied to the electrostatic latent images formed on the surface of the photosensitive drum 27. Then, the developer is selectively carried on the surface of the photosensitive drum 27 and changed to a visible image, whereby a developer image is formed by reversal development.

Thereafter, the photosensitive drum 27 and a transfer roller 30 are rotated to convey the sheet 3 pinched between them, and when the sheet 3 is conveyed while being pinched between the photosensitive drum 27 and the transfer roller 30, the developer image carried on the surface of the photosensitive drum 27 is transferred onto the sheet 3.

(6) Fixing Unit

The fixing unit 18 includes a heating roller 41 and a pressure roller 42. In the fixing unit 18, the developer transferred onto the sheet 3 is thermally fixed during the passage of the sheet 3 between the heating roller 41 and the pressure roller 42. Moreover, the sheet 3 thermally fixed in the fixing unit 18 is delivered to a sheet discharge tray 46 by a sheet discharge roller 45 disposed on the downstream side of the fixing unit 18.

(7) Developer Cartridge

Figure 2:
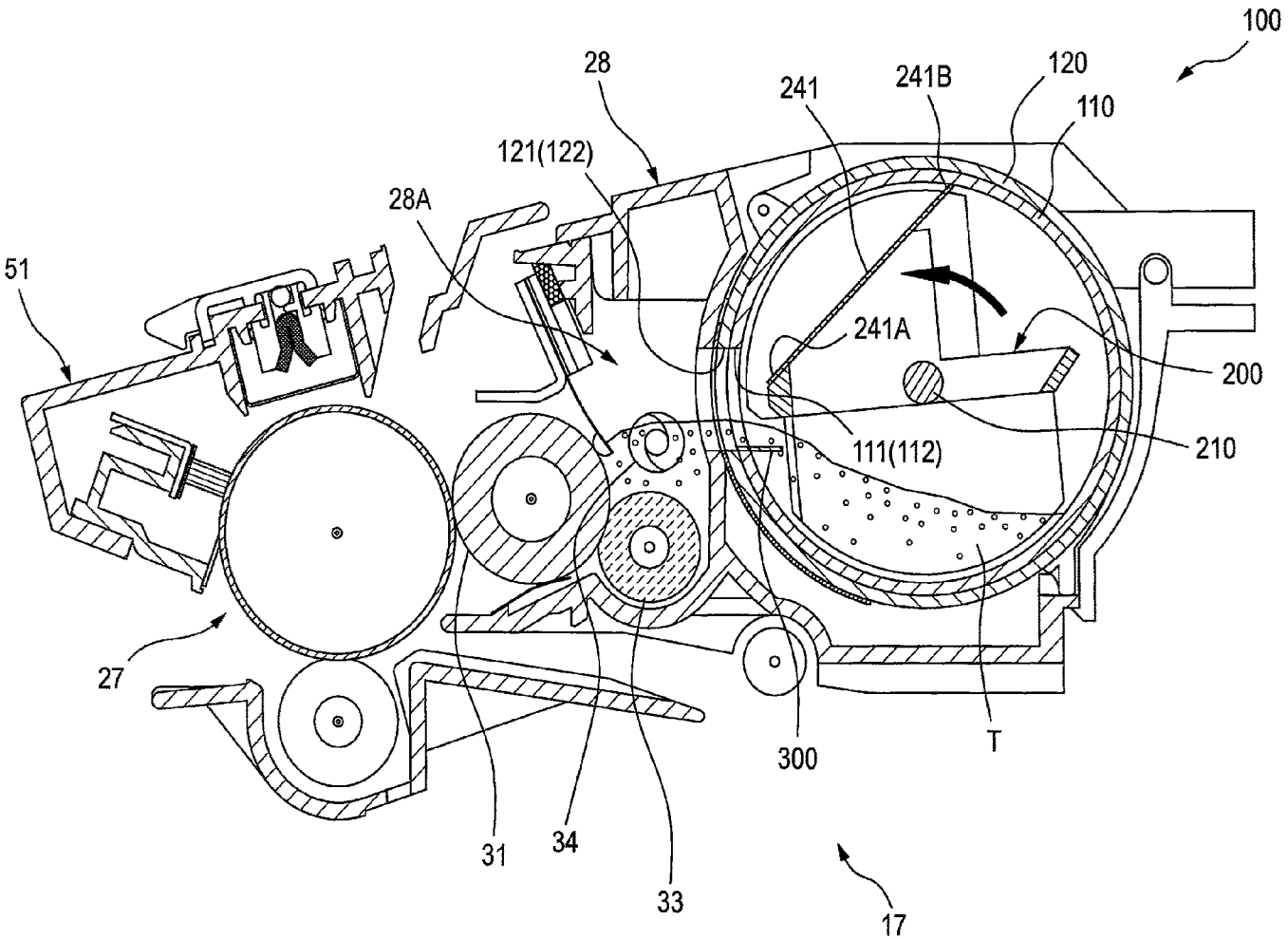
FIG. 2 is an enlarged sectional view of a developer cartridge.
Figure 3A:
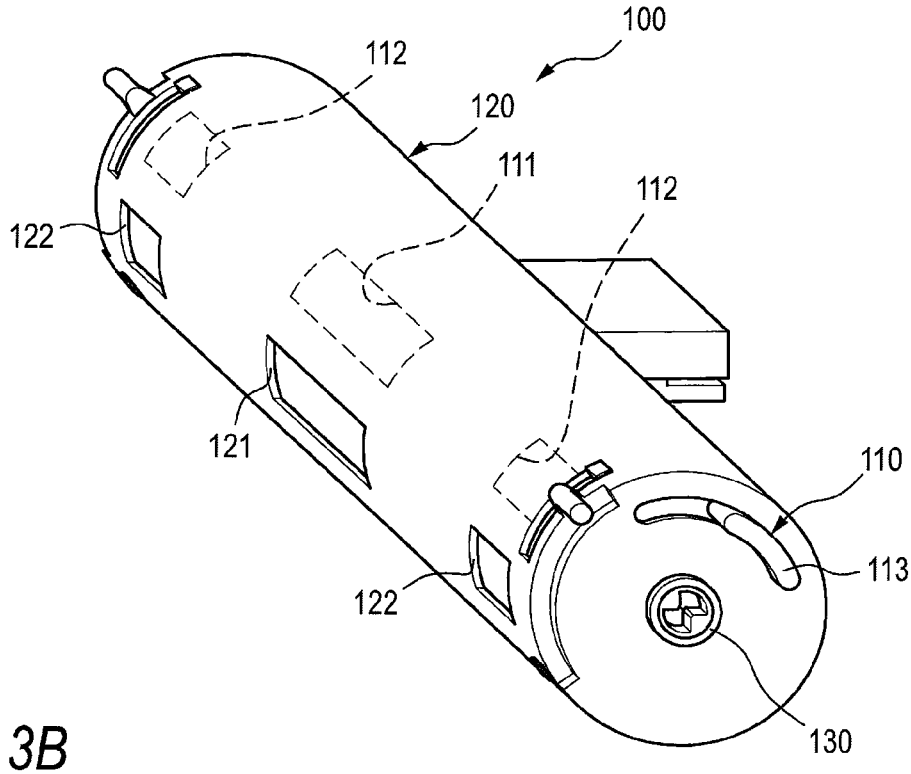
FIG. 3A is a perspective view of the developer cartridge in a closed state.
Figure 3B:
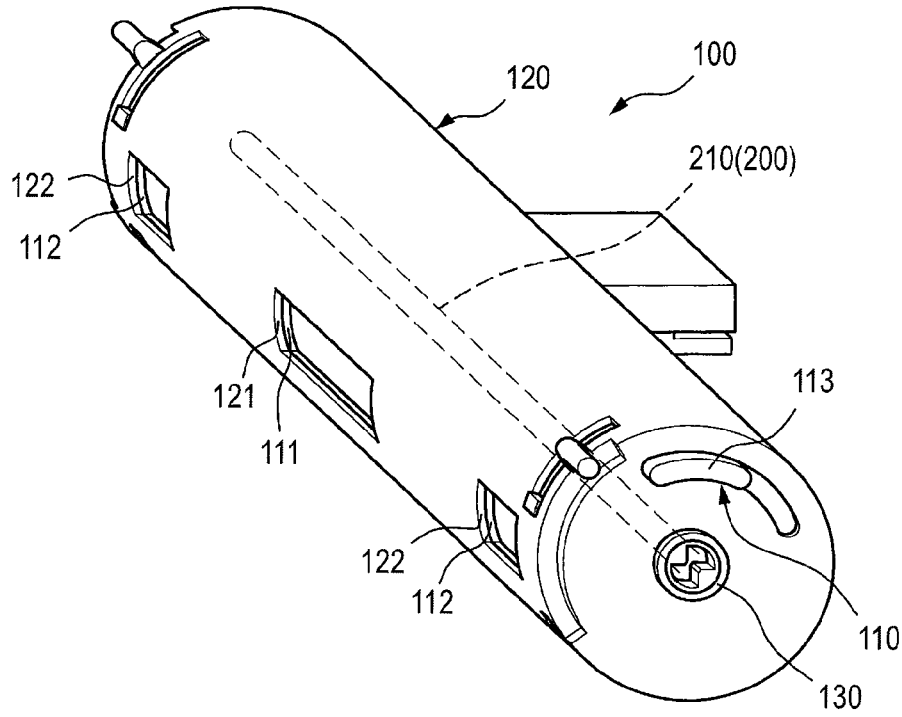
FIG. 3B is a perspective view of the developer cartridge in an open state.

Next, the detailed structure of the developer cartridge 100 as an example of a developer cartridge according to the present invention will be described. In the drawings, FIG. 2 is an enlarged sectional view illustrating a detailed structure of a developer cartridge. FIG. 3A is a perspective view of the developer cartridge in a closed state, and FIG. 3B is a perspective view of the developer cartridge in an open state.

As shown in FIG. 2, the developer cartridge 100 constitutes the process cartridge 17 together with the developing cartridge 28 and the drum unit 51 described above, and the developer cartridge 100 is detachably attached to the developing cartridge 28. Specifically, the developer cartridge 100 includes an inside housing 110 configured to accommodate developer T therein, an outside housing 120 configured to be displaced relative to the inside housing 110, and the agitator 200.

The inside housing 110 has a hollow, cylindrical shape, and is rotatably supported by a substantially cylindrical, inner circumferential surface of the outside housing 120. Moreover, a supply opening 111 for supplying the developer T to the inside of the developing cartridge 28 is formed in a portion at the side of the developing cartridge 28 of an outer circumferential wall (a wall opposite a rotation shaft 210 of the agitator 200 in the diameter direction) of the cylindrical shape of the inside housing 110. Moreover, as shown in FIG. 3B, the supply opening 111 is formed at a center portion in the axial direction of the inside housing 110. Furthermore, return openings 112 for returning the developer T from a developing chamber 28A (see FIG. 2) in the developing cartridge 28 to the inside of the developer cartridge 100 are formed at both the left and right sides (opposite positions in the axial direction of the inside housing 110) of the supply opening 111.

The outside housing 120 has a substantially hollow, cylindrical shape, and at corresponding portions at the side of the developing cartridge 28 of an outer circumferential wall of the cylindrical shape of the outside housing 120, a supply opening 121 communicating with the supply opening 111 of the inside housing 110 and return openings 122 communicating with the return openings 112 of the inside housing 110. That is, the supply opening 121 and the return openings 122 of the outside housing 120 are formed at positions corresponding to the supply opening 111 and the return openings 112 of the inside housing 110, the three ports being arranged in the axial direction.

A gear part 130 is disposed on an end surface at one end side of the outside housing 120, the gear part 130 being fixed at an end portion of a rotation shaft 210 of the agitator 200 that is rotatably provided to the inside housing 110 and the outside housing 120. When driving force is transmitted from the side of the body casing 2 to the gear part 130, the agitator 200 is rotated.

The inside housing 110 and the outside housing 120 having the above-described construction are configured such that when developer cartridge 100 is attached to the developing cartridge 28, the outside housing 120 is fixed to the developing cartridge 28 and the inside housing 110 is rotated relative to the outside housing 120. The rotation structure is well known: to briefly describe, a projection 113 having a circular arc shape formed at an end portion of the inside housing 110 shown in FIG. 3A engages with a lever (not shown) and is moved along the circular arc shape by a lever operation, whereby the inside housing 110 is rotated relative to the outside housing 120. Moreover, in a state shown in FIG. 3A where the developer cartridge 100 is not attached thereto, the supply opening 111 and the return openings 112 of the inside housing 110 are closed by the circumferential wall of the outside housing 120. Meanwhile, in a state shown in FIG. 3B where the developer cartridge 100 is attached and the inside housing 110 is rotated, the supply opening 111 and the return openings 112 of the inside housing 110 are communicated with the supply opening 121 and the return openings 122 of the outside housing 120 so that the developer T can be supplied through the ports.

Figure 4A:
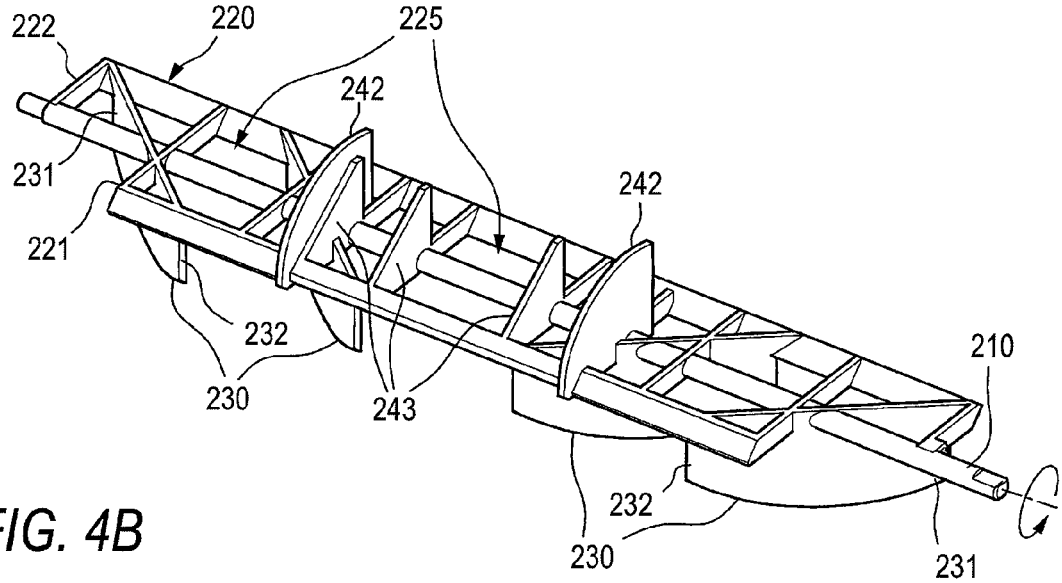
FIG. 4A is a perspective view of an agitator showing the state where a plate-shaped portion is detached therefrom.
Figure 4B:
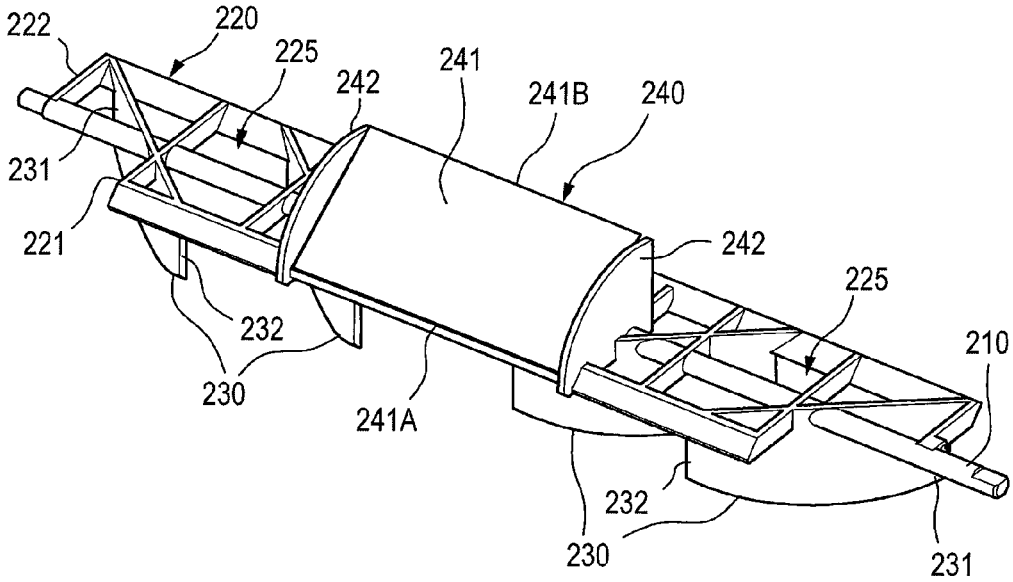
FIG. 4B is a perspective view of the agitator showing the state where the plate-shaped portion is attached thereto.

As shown in FIGS. 4A and 4B, the agitator 200 includes the rotation shaft 210, a support wall 220, an oblique agitation blade 230, which is an example of the first agitation blade, and a delivery agitation blade 240, which is an example of the second agitation blade.

As shown in FIG. 3B, the rotation shaft 210 is rotatably supported by the inside housing 110 and the outside housing 120 and is configured to pass across the inside of the inside housing 110 (specifically, the rotation shaft 210 is coaxial to the center axis of the inside housing 110).

The support wall 220 is formed integral with the rotation shaft 210 and includes a first support frame portion 221 that extends from the rotation shaft 210 toward one side in the diameter direction and a second support frame portion 222 that extends from the rotation shaft 210 toward a side opposite to the extending direction of the first support frame portion 221. The first support frame portion 221 is shorter than the second support frame portion 222 in the axial direction of the rotation shaft 210, and a portion of the support wall 220 opposite the return openings 112 (see FIGS. 3A and 3B) of the inside housing 110 has a notch shape. In addition, the first support frame portion 221 and the second support frame portion 222 have a lattice shape, and a plurality of openings 225 are formed in the support wall 220.

The oblique agitation blade 230 has a distal end thereof formed along the inner circumferential surface of the inside housing 110, and is oblique to the rotation shaft 210 over portions of the support wall 220 from the distal end of the first support frame portion 221 to the distal end of the second support frame portion 222. Specifically, two oblique agitation blades 230 (four in total) are provided on the support wall 220 with the supply opening 111 disposed between them so that an end portion 232 at the backward side in the rotation direction of the rotation shaft 210 is positioned closer to the supply opening 111 (see FIG. 3) of the inside housing 110 than an end portion 231 at the forward side in the rotation direction of the rotation shaft 210. More specifically, the end portion 231 of the oblique agitation blade 230 at the forward side in the rotation direction is integrally formed on the second support frame portion 222, and the end portion 232 at the backward side in the rotation direction is integrally formed on the first support frame portion 221. Moreover, among the four oblique agitation blades 230, the oblique agitation blades 230 at both end sides in the axial direction of the rotation shaft 210 are configured to pass through a position opposite the return openings 112 from the above to the below along the inner circumferential surface of the inside housing 110 when the rotation shaft 210 is rotated in the arrow direction shown in FIG. 4A.

As shown in FIG. 4B, the delivery agitation blade 240 is provided at a side of the support wall 220 opposite to the oblique agitation blades 230, specifically at the side of the first support frame portion 221 of the support wall 220. The delivery agitation blade 240 includes a plate-shaped portion 241 that is obliquely provided to the support wall 220 and guide walls 242 that are provided at both sides of the plate-shaped portion 241 in the axial direction of the rotation shaft 210.

The plate-shaped portion 241 is supported by four, triangular ribs 243 (only three of them are illustrated) shown in FIG. 4A, whereby when a front end thereof 241A at the forward side in the rotation direction is opposed to the supply opening 111 of the inside housing 110 as shown in FIG. 2, a rear end thereof 241B at the backward side in the rotation direction is positioned above the front end 241A. Incidentally, the rear end 241B in this example is always positioned above the front end 241A when the front end 241A is positioned at each of the positions from the lower end to the upper end of the supply opening 111. Alternatively, the rear end 241B may not be always positioned at each of the positions as long as the rear end 241B is positioned above the front end 241A (i.e., the lower end of the supply opening 111) when the front end 241A is positioned at least at the lower end of the supply opening 111.

As shown in FIG. 4A, the guide walls 242 are formed so as to extend from the support wall 220 toward the outer side in the diameter direction of the rotation shaft 210. A distal end thereof protrudes further outward in the diameter direction of the rotation shaft 210 than the plate-shaped portion 241 and is formed along the inner circumferential surface of the inside housing 110. The delivery agitation blade 240 having the construction described above is provided to the rotation shaft 210 integral with the support wall 220 and is thus rotated in the same direction as the oblique agitation blade 230 (that is, the delivery agitation blade 240 passes through a position opposite the supply opening 111 from the above to the below along the inner circumferential surface of the inside housing 110).

As shown in FIG. 2, flexible film 300 that extends toward the rotation shaft 210 is provided at the lower end of the supply opening 111 of the inside housing 110. Specifically, the flexible sheet 300 has such a length that it does not make abutting contact with the front end 241A of the plate-shaped portion 241 of the rotating agitator 200.

Figure 5A:
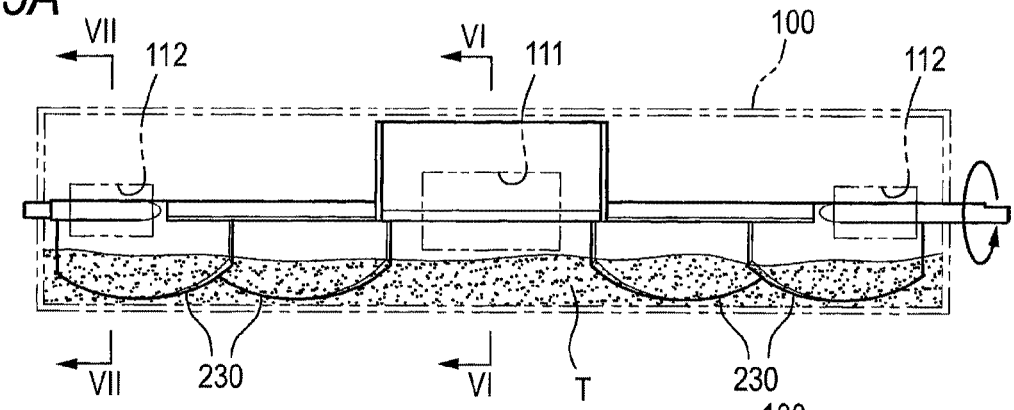
Figure 5B:
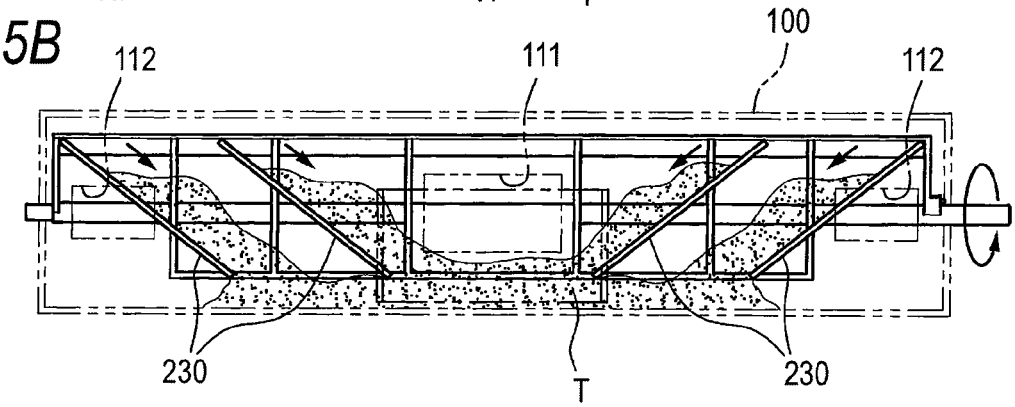
Figure 5C:
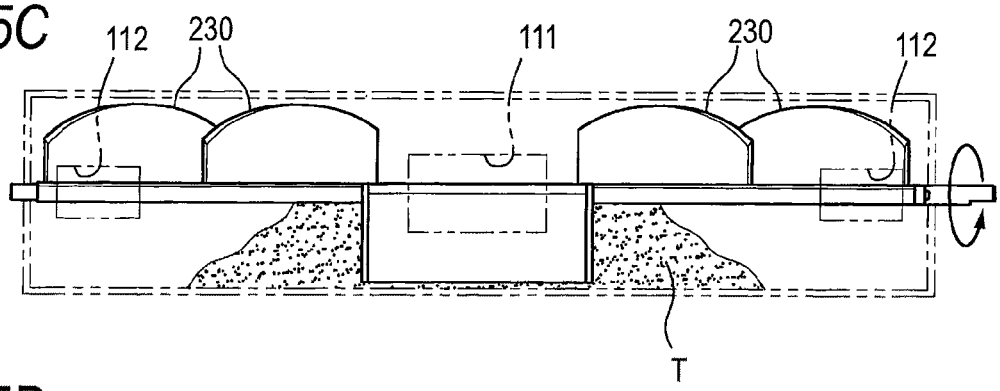
Figure 5D:
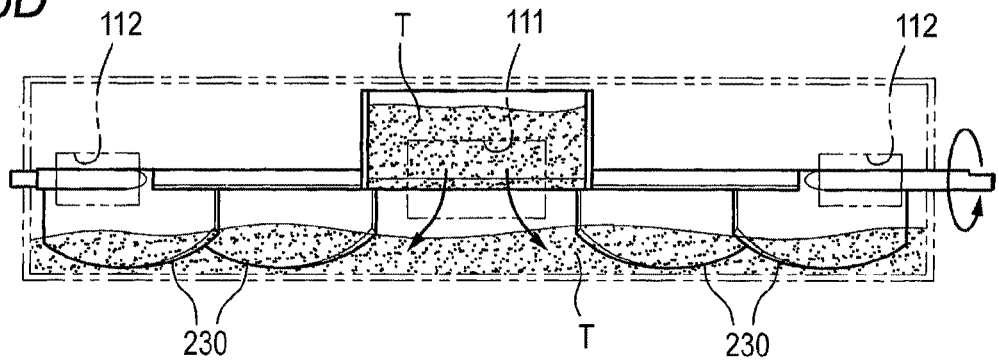

Next, the operation of the agitator 200 according to the present invention will be described. In the drawings, FIGS. 5A to 5D are diagrams showing an operation of the agitator, in which FIG. 5A is a front view showing a state where an oblique agitation blade is positioned at a lower half portion of an inside housing, FIG. 5B is a front view showing a state where developer is conveyed toward a supply opening side by the oblique agitation blade, FIG. 5C is a front view showing a state where a delivery agitation blade is positioned at the lower half portion of the inside housing, and FIG. 5D is a front view showing a state where developer slips off from the delivery agitation blade and is delivered through the supply opening into the developing chamber. FIGS. 6A to 6D are sectional views taken along the line VI-VI in FIG. 5A. FIGS. 7A to 7D are sectional views taken along the line VII-VII in FIG. 5A. In FIGS. 7A to 7D, the oblique agitation blade 230 is schematically illustrated without being taken along the line VII-VII in FIG. 5A for the sake of explanation.

Figure 6A:
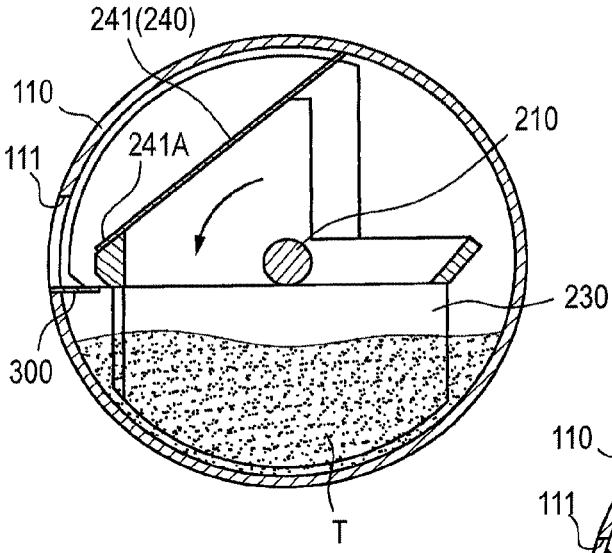
Figure 6B:
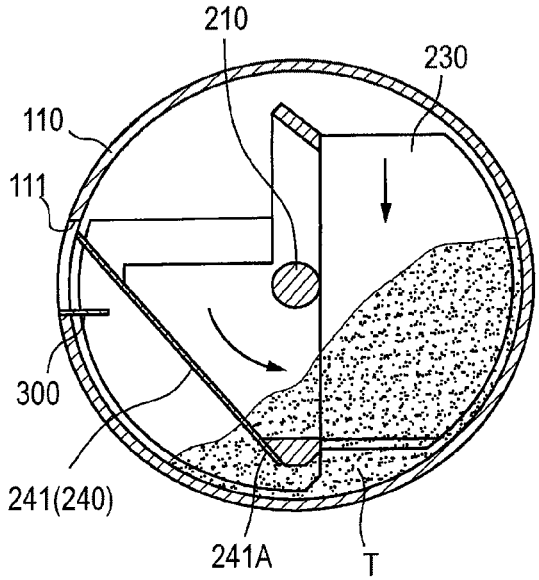

As shown in FIGS. 5A and 6A, when the agitator 200 is rotated from the state where the oblique agitation blade 230 is positioned at the lower half portion of the inside housing 110 so that the oblique agitation blade 230 is positioned at a side opposite the supply opening 111 with the rotation shaft 210 disposed therebetween as shown in FIG. 6B, developer T slips off from the oblique agitation blade 230 as shown in FIG. 5B and is conveyed from the side of the return openings 112 to the side of the supply opening 111 (toward the center of the inside housing 110 in the axial direction).

Figure 6C:
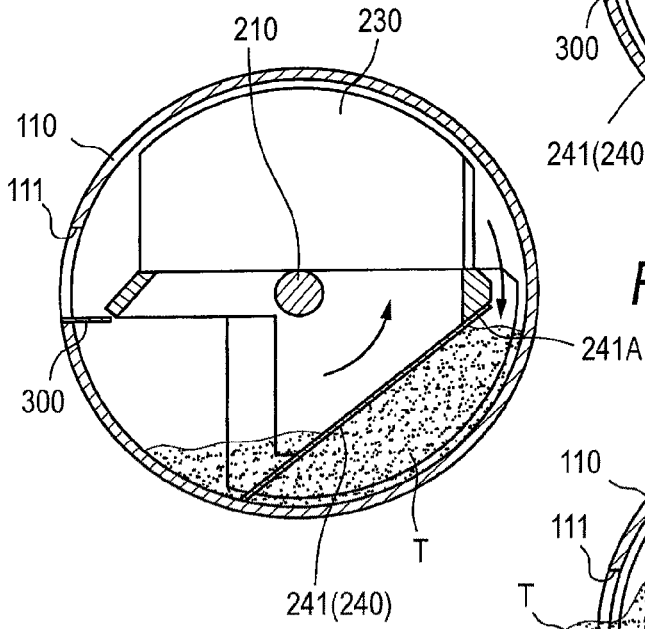
Figure 6D:
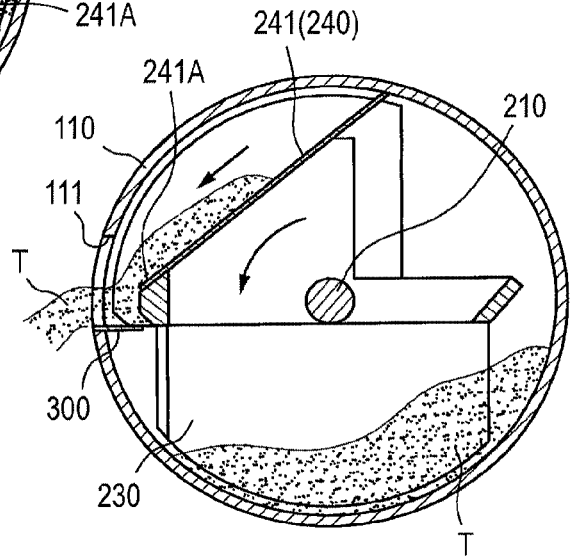

Subsequently, when the agitator 200 is rotated further, as shown in FIGS. 5C and 6C, the developer T conveyed to the center in the axial direction of the inside housing 110 is taken upward by the delivery agitation blade 240 and conveyed by the delivery agitation blade 240. Moreover, as shown in FIGS. 5D and 6D, when the front end 241A of the plate-shaped portion 241 of the delivery agitation blade 240 is moved to a position opposite the supply opening 111 of the inside housing 110, the developer T slips off from the plate-shaped portion 241 and is delivered through the supply opening 111 to the developing chamber 28A. Moreover, at this time, the developer T is supported by the flexible film 300 that is provided so as to cover a gap between the inner surface of the inside housing 110 and the front end 241A of the plate-shaped portion 241. Therefore, the developer T can be delivered through the supply opening 111 to the developing chamber 28A without falling in the lower half portion of the inside housing 110.

In this manner, when the developer T is delivered through the supply opening 111, the amount of the developer T in the developing chamber 28A becomes a predetermined amount or more, and the overflowing developer T is returned through the return openings 112 to the inside of the developer cartridge 100. At this time, since the notch portion (see FIGS. 4A and 4B) of the support wall 220 is disposed at the position opposite the return openings 112, the developer T can be efficiently returned through the return openings 112 to the inside of the inside housing 110.

Figure 7A:
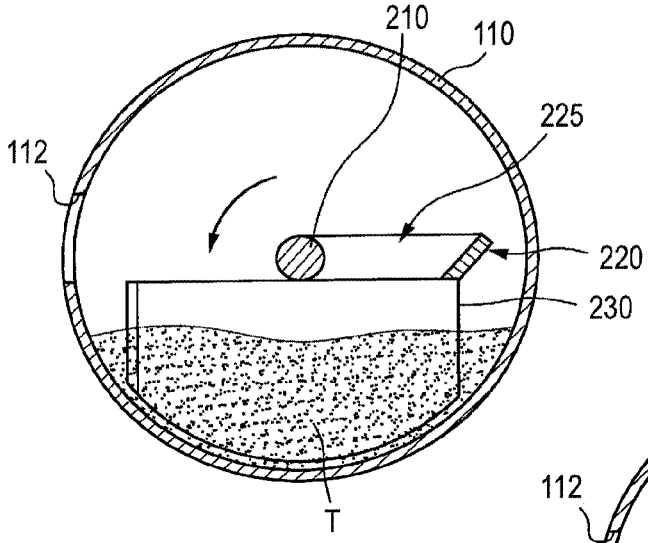
Figure 7B:
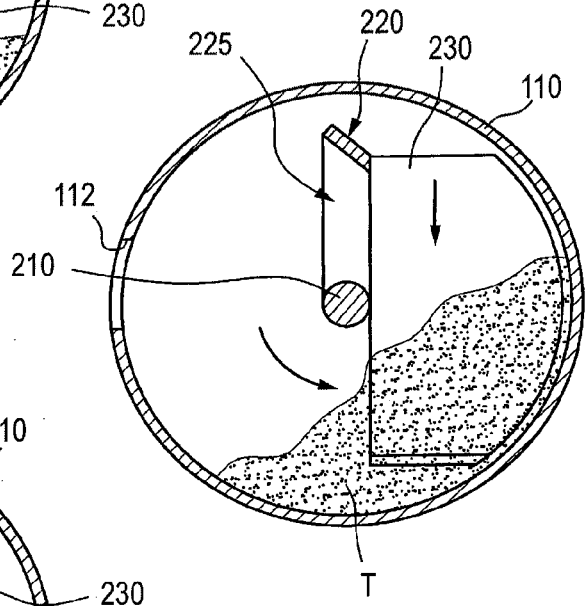
Figure 7C:
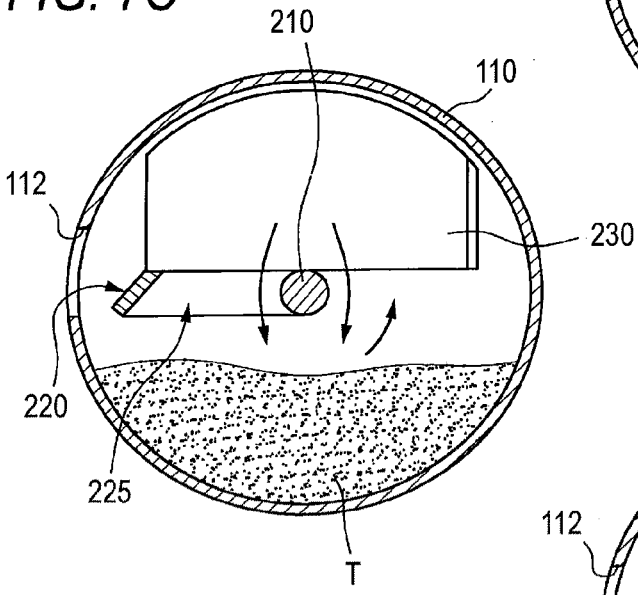
Figure 7D:
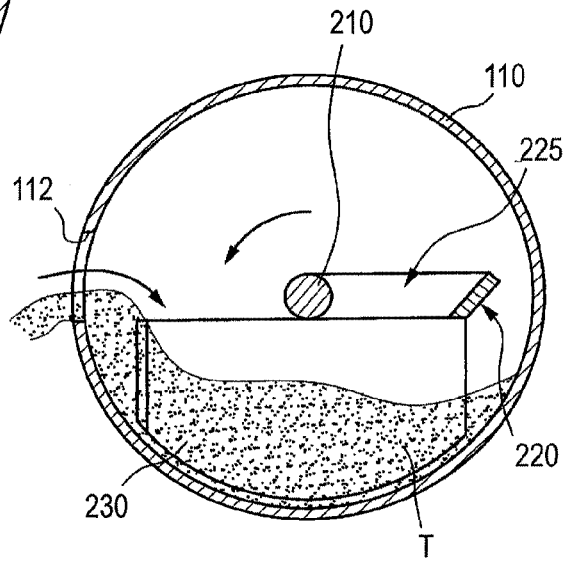

Moreover, the oblique agitation blade 230 disposed at a position opposite the return openings 112 conveys the developer T to the side of the supply opening 111 as shown in FIGS. 7A and 7B and thereafter passes through the upper half portion of the inside housing 110 as shown in FIG. 7C. At this time, since the developer T falls through the openings 225 of the support wall 220, as shown in FIG. 7D, when the oblique agitation blades 230 pass through the return openings 112, the developer T in the inside housing 110 is not discharged through the return openings 112 to the developing chamber 28A. Furthermore, since the oblique agitation blades 230 pass through the return openings 112 from the above to the below, as shown in FIGS. 7C and 7D, the developer T returned through the return openings 112 to the inside of the inside housing 110 is scraped by the oblique agitation blades 230 and received in the inside housing 110. For this reason, it is possible to suppress the developer T from being forced back toward the developing chamber 28A by the oblique agitation blades 230, and the developer T is efficiently returned to the inside of the inside housing 110.

According to the configuration described above, the following advantages can be obtained.

Since the oblique agitation blades 230 are rotated so that they pass through the return openings 112 from the above to the below, the developer T can be efficiently returned through the return openings 112 to the inside of the inside housing 110, and circulation of the developer T can be improved.

Since the plate-shaped portion 241 that is disposed oblique to the support wall 220 is configured to deliver the developer T through the supply opening 111 to the developing chamber 28A, it is possible to efficiently deliver a lot of developer T to the developing chamber 28A when the delivery agitation blade 240 passes through the supply opening 111 from the above to the below.

Since the guide walls 242 are provided at both sides of the plate-shaped portion 241, it is possible to suppress the developer T on the plate-shaped portion 241 from overflowing from both sides of the plate-shaped portion 241. Accordingly, a large amount of developer T can be conveyed to the supply opening 111.

Since the flexible film 300 is provided at the lower end of the supply opening 111, it is possible to suppress the developer T from overflowing from the delivery agitation blade 240 and falling in the lower half portion of the inside housing 110. Accordingly, a larger amount of developer T can be conveyed to the supply opening 111.

SECOND EXAMPLE

Figure 8:
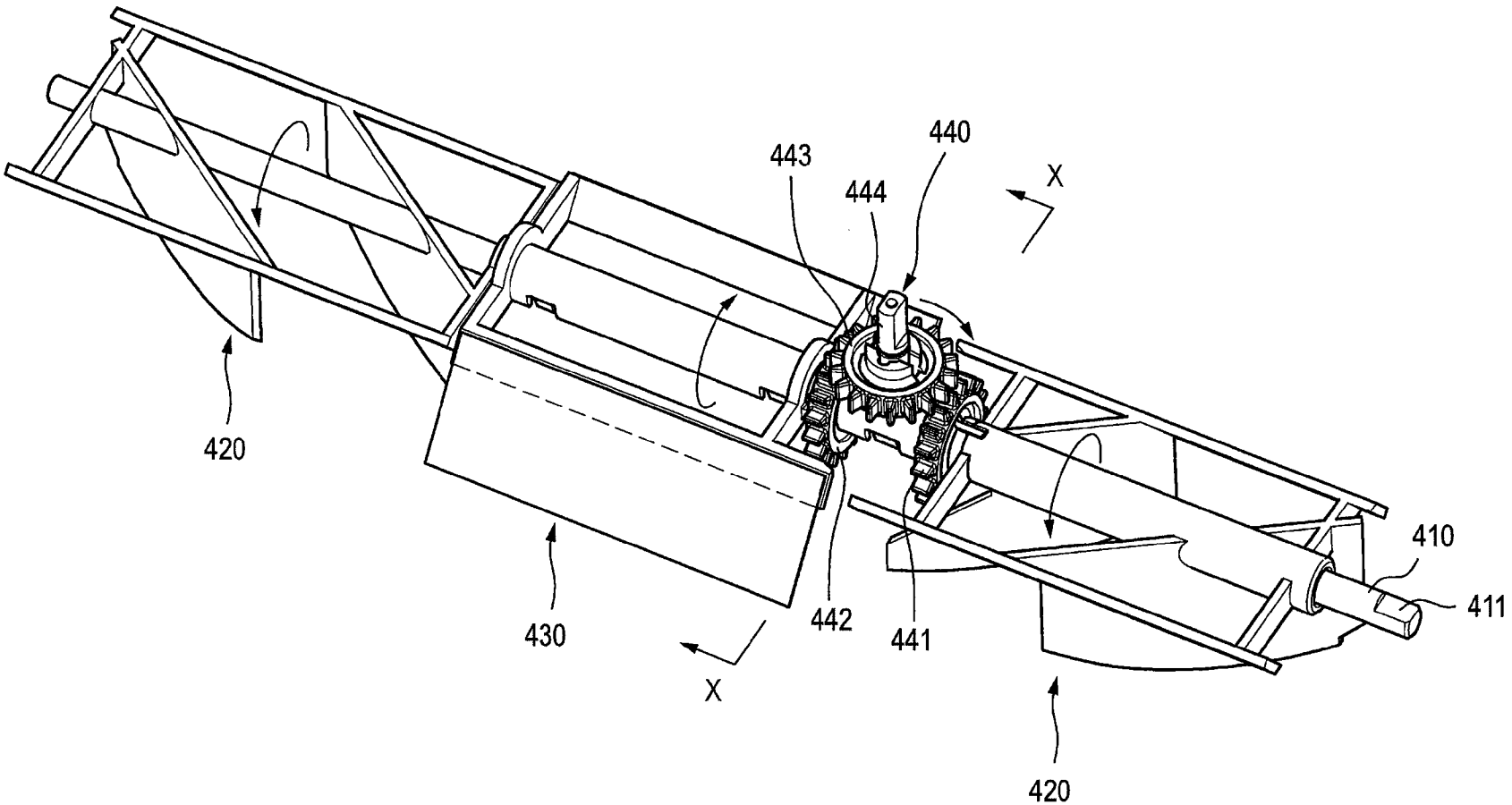
FIG. 8 is a perspective view of an agitator according to a second example of the invention.
Figure 9:
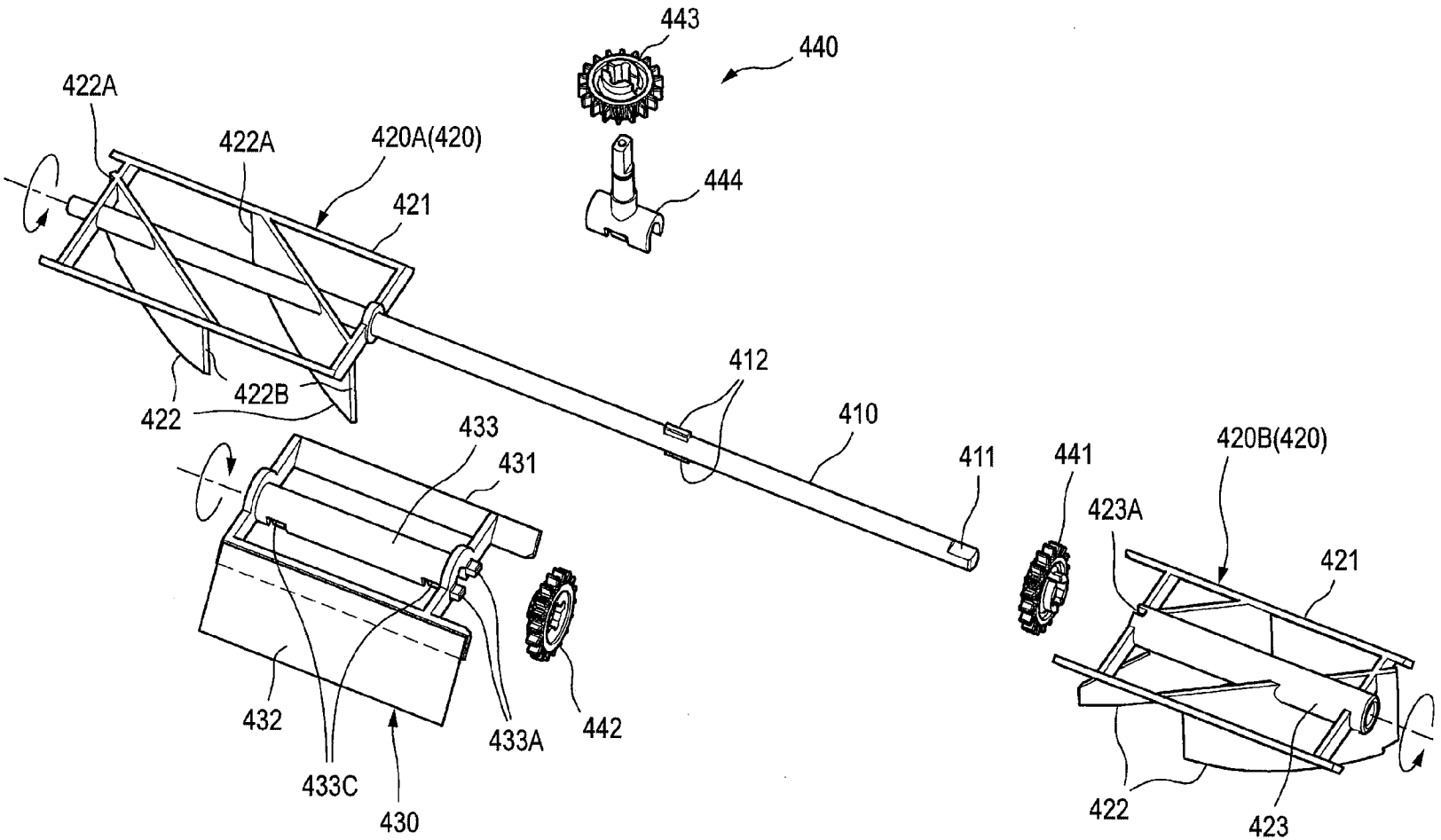
FIG. 9 is an exploded perspective view of the agitator shown in FIG. 8.
Figure 10A:
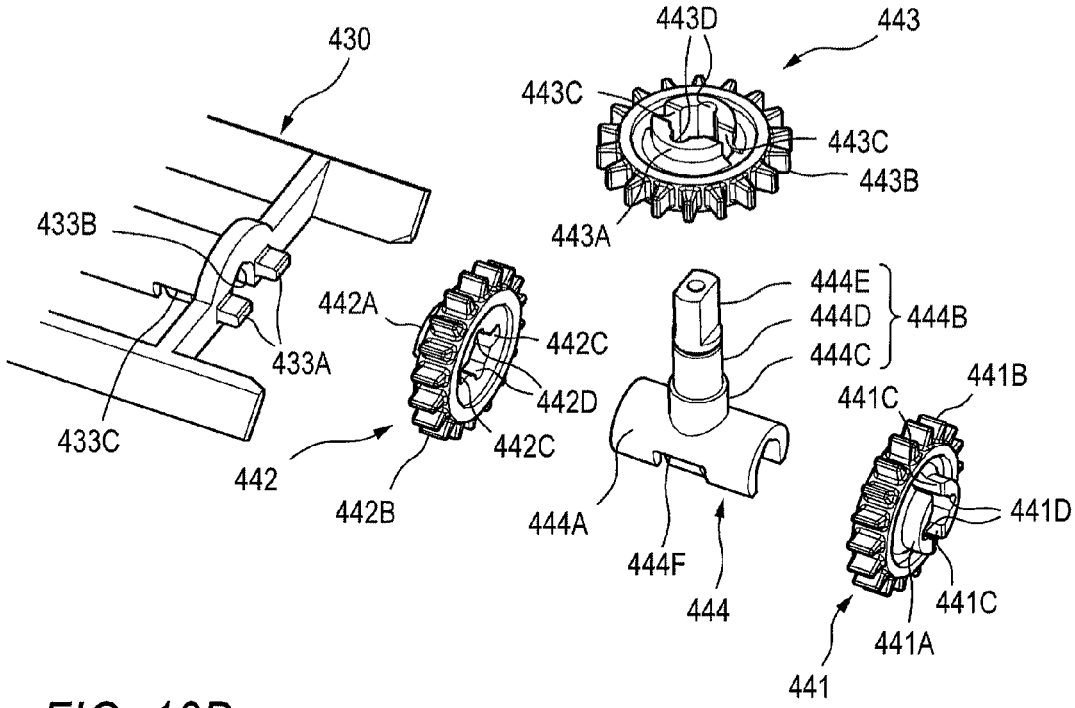
FIG. 10A is an exploded perspective view of a gear mechanism.
Figure 10B:
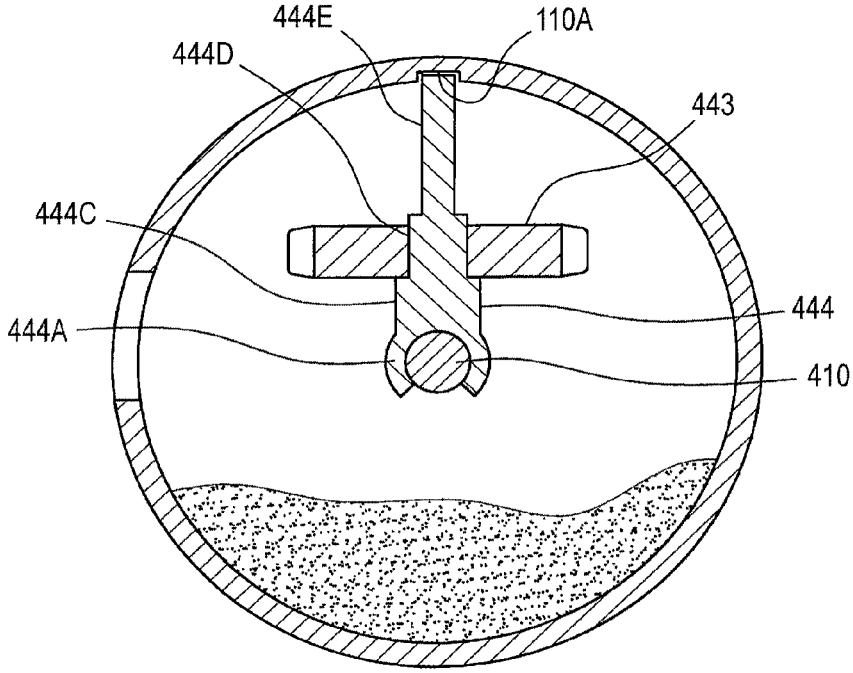
FIG. 10B is a sectional view taken along the line X-X in FIG. 8.

Next, a second example of the present invention will be described in detail by appropriately referring to the attached drawings. In the second example, the structure of the agitator according to the first example is modified, and the same components as the first example will be denoted by the same reference numerals and will not be described. In the drawings, FIG. 8 is a perspective view of an agitator according to the second example. FIG. 9 is an exploded perspective view of the agitator shown in FIG. 8. FIG. 10A is an exploded perspective view of a gear mechanism, and FIG. 10B is a sectional view taken along the line X-X in FIG. 8.

As shown in FIG. 8, the agitator 400 according to the second example includes a rotation shaft 410, a pair of oblique agitation blade units 420, a delivery agitation blade unit 430, and a gear mechanism 440, which is an example of a driving unit.

As shown in FIG. 9, the rotation shaft 410 has one end portion thereof 411 that is connected to the gear part 130 (see FIGS. 3A and 3B), whereby the rotation shaft 410 is rotated when driving force is transmitted thereto from the side of the one end portion 411. Moreover, at the other end portion of the rotation shaft 410, one (first oblique agitation blade unit 420A) of the pair of oblique agitation blade units 420 is integrally formed. Meanwhile, a pair of latching protrusions 412 is formed at corresponding portions closer to the one end side than the center of the rotation shaft 410 so as to protrude outward in the diameter direction. The latching protrusions 142 are configured to latch the other (second oblique agitation blade unit 420B) of the pair of oblique agitation blade units 420 and a first gear 441 described later.

The oblique agitation blade units 420 includes the first oblique agitation blade unit 420A that is integrally formed with the rotation shaft 410 and the second oblique agitation blade unit 420B that is rotatably supported by the rotation shaft 410.

The first oblique agitation blade unit 420A includes a support frame 421 and two oblique agitation blades 422, which are an example of the first agitation blade. The support frame 421 generally has a rectangular frame shape and a center portion thereof in the diameter direction of the rotation shaft 410 is integrally formed with the rotation shaft 410. Each of the oblique agitation blades 422 is integrally formed with the support frame 421 and the rotation shaft 410 in the same shape and posture as the oblique agitation blades 230 according to the first example. That is, the oblique agitation blades 422 are arranged such that end portions thereof 422B at the backward side in the rotation direction of the rotation shaft 410 are positioned closer to the supply opening 111 (see FIGS. 3A and 3B) of the inside housing 110 than end portions thereof 422A at the forward side in the rotation direction.

The second oblique agitation blade unit 420B includes substantially the same support frame 421 and the same two oblique agitation blades 422 as the first oblique agitation blade unit 420A and further includes an approximately cylindrical shaft portion 423 configured to rotatably engage with the rotation shaft 410. Moreover, a key groove 423A is formed in an end portion of the shaft portion 423 close to the first oblique agitation blade unit 420A so as to engage with the latching protrusions 412 of the rotation shaft 410. For this reason, the second oblique agitation blade unit 420B is integrally rotated with the rotation shaft 410 when the key groove 423A is engaged with the latching protrusions 412 of the rotation shaft 410.

The delivery agitation blade unit 430 includes a support frame 431, a delivery agitation blade 432, which is an example of the second agitation blade, and a shaft portion 433 that is integrally formed with the support frame 431. The support frame 431 generally has a rectangular frame shape and a center portion thereof in the diameter direction of the rotation shaft 410 is integrally formed with the shaft portion 433. The delivery agitation blade 432 is generally rectangular flexible sheet, and one end thereof is fixed to one end of the support frame 431 in the diameter direction of the rotation shaft 410, whereby the other end thereof is bent to make sliding contact with the inner circumferential surface of the inside housing 110. The shaft portion 433 generally has a C shape (approximately cylindrical shape) and is configured to rotatably engage with the rotation shaft 410. Moreover, at an end portion of the shaft portion 433 close to the gear mechanism 440, a pair of latching protrusions 433A configured to latch a second gear 442 in the rotation direction are formed so as to protrude toward the gear mechanism 440. Furthermore, in the inner circumferential surface of the shaft portion 433, a relief groove 433B (see FIG. 10A) is formed for preventing the delivery agitation blade unit 430 from interfering with the latching protrusions 412 of the rotation shaft 410 when the delivery agitation blade unit 430 is inserted from the one end side of the rotation shaft 410. The delivery agitation blade unit 430 having the construction described above is configured to be rotated in the backward direction by the gear mechanism 440 in a manner independent from the oblique agitation blade unit 420. Moreover, delivery opening portions 433C are formed at both end sides of the lower portion of the shaft portion 433 in order to deliver developer entering into the shaft portion 433 to the outside. With such a configuration, it is possible to prevent the developer entering into a gap between the shaft portion 433 and the rotation shaft 410 from sticking thereto, whereby the delivery agitation blade unit 430 can be efficiently rotated.

The gear mechanism 440 is disposed between the delivery agitation blade unit 430 and the second oblique agitation blade unit 420B at one end side of the rotation shaft 410 (see FIG. 8). The gear mechanism 440 includes the first gear 441, the second gear 442, a third gear 443, and a gear holding member 444. Here, the first gear 441, the second gear 442 and the third gear 443 have the same structure, and therefore, only the structure of the first gear 441 will be described. In the second example, since the first gear 441, the second gear 442 and the third gear 443 have same structure, the number of components can be decreased. Alternatively, the first gear 441, the second gear 442 and the third gear 443 may have mutually different structures.

As shown in FIG. 10A, the first gear 441 has a cylindrical rotating cylinder portion 441A formed at the center thereof to which the rotation shaft 410 is inserted and a gear tooth portion 441B formed in the outer circumferential surface thereof. In the rotating cylinder portion 441A, a pair of key grooves 441C is formed at both sides of the center of the rotating cylinder portion 441A so as to be communicated with each other from the inner circumferential surface side to the outer circumferential surface side and from one end side thereof to the other end side thereof. Moreover, the key grooves 441C are configured to engage with the latching protrusions 412 of the rotation shaft 410 shown in FIG. 9. For this reason, the first gear 441 is integrally rotated with the rotation shaft 410 and the oblique agitation blade unit 420 in a state where the key grooves 441C are engaged with the latching protrusions 412 of the rotation shaft 410. Moreover, a pair of relief grooves 441D are formed in the rotating cylinder portion 441A at positions displaced by about 90 degrees from the key grooves 441C so as to be communicated with each other from one end side of the rotating cylinder portion 441A to the other end side. For this reason, even when developer enters into the rotating cylinder portion 441A, the developer can be delivered to the outside through the relief grooves 441D.

The second gear 442 includes a rotating cylinder portion 442A, a gear tooth portion 442B, key grooves 442C, and relief grooves 442D, all of which have the same structure as those of the first gear 441. The key grooves 442C of the second gear 442 are configured to engage with the latching protrusions 433A of the delivery agitation blade unit 430 shown in FIG. 9. For this reason, the second gear 442 is integrally rotated with the delivery agitation blade unit 430 in a state where the key grooves 442C are engaged with the latching protrusions 433A of the delivery agitation blade unit 430. Moreover, the relief grooves 442D of the second gear 442 are in agreement with the relief grooves 433B of the delivery agitation blade unit 430 when the key grooves 442C of the second gear 442 engage with the latching protrusions 433A of the delivery agitation blade unit 430. For this reason, the delivery agitation blade unit 430 can be inserted into the rotation shaft 410 from one end side to the center portion in a state where the second gear 442 is set to the delivery agitation blade unit 430. Moreover, even when developer enters into the rotating cylinder portion 442A, the developer can be delivered to the outside through the relief grooves 442D.

The third gear 443 includes a rotating cylinder portion 443A, a gear tooth portion 443B, key grooves 443C, and relief grooves 443D, all of which have the same structure as those of the first gear 441. In the third gear 443, the key grooves 443C do not have any special function, and the relief grooves 443D contribute to the discharge of developer entering into the rotating cylinder portion 443A. The third gear 443 is held by the gear holding member 444, whereby as shown in FIG. 10B, the third gear 443 is disposed above the rotation shaft 410 and rotated in a circumferential direction perpendicular to the rotation shaft 410 so as to engage with the first gear 441 and the second gear 442.

The first gear 441, the second gear 442 and the third gear 443 having the construction described above have the respective gear tooth portions 441B, 442B and 443B having a spur gear shape with a large tooth gap. Accordingly, the first gear 441, the second gear 442 and the third gear 443 make point contact with each other in order to transmit power.

The gear holding member 444 is disposed between the first gear 441 and the second gear 442 and includes a rotation shaft support portion 444A and a gear support portion 444B. The rotation shaft support portion 444A has an approximately C-shaped section and is rotatably engaged with the rotation shaft 410 as shown in FIG. 10B. The gear support portion 444B is integrally formed with the rotation shaft support portion 444A so as to protrude upward (a direction perpendicular to the axial direction) from a center portion in the axial direction of the rotation shaft support portion 444A. The gear support portion 444B includes a large diameter portion 444C, a small diameter portion 444D, and an engagement portion 444E, which are sequentially arranged from the side of the rotation shaft support portion 444A. The large diameter portion 444C has a diameter larger than the diameter of a hole formed in the rotating cylinder portion 443A of the third gear 443, whereby the large diameter portion 444C supports the third gear 443 from the below. The small diameter portion 444D has a substantially the same diameter as that of the hole formed in the rotating cylinder portion 443A of the third gear 443, whereby the small diameter portion 444D rotatably supports the third gear 443. The engagement portion 444E extends upward from an end surface of the small diameter portion 444D and is configured to engage with an engagement hole 110A formed in an upper portion of the inner circumferential surface of the inside housing 110 as shown in FIG. 10B. Moreover, a discharge opening portion 444F is formed at the center of the lower portion of the rotation shaft support portion 444A in order to discharge developer entering into the rotation shaft support portion 444A to the outside. With such a configuration, it is possible to prevent the developer entering into a gap between the rotation shaft support portion 444A and the rotation shaft 410 from sticking thereto, whereby the rotation shaft 410 can be efficiently rotated.

Next, the operation of the agitator 400 according to the second example will be described. In the drawings, FIGS. 11A and 11B are diagrams illustrating the conveyance of developer by the delivery agitation blade, in which FIG. 11A is a sectional view showing the state the delivery agitation blade is positioned at the lower half portion of the inside housing, and FIG. 11B is a sectional view showing the state where developer is pushed through the supply opening into the developing chamber by the delivery agitation blade.

When a driving device (not shown) of the image forming apparatus 1 is activated, the driving force is transmitted to the one end portion 411 of the agitator 400 shown in FIG. 8, whereby the rotation shaft 410 and the oblique agitation blade unit 420 are rotated in the arrow direction (a direction of passing through the return openings 112 from the above to the below). The driving force is transmitted to the delivery agitation blade unit 430 while the direction of the driving force is reversed via the gear mechanism 440, whereby the delivery agitation blade unit 430 is rotated in a direction opposite to the rotation direction of the oblique agitation blade unit 420.

Figure 11A:
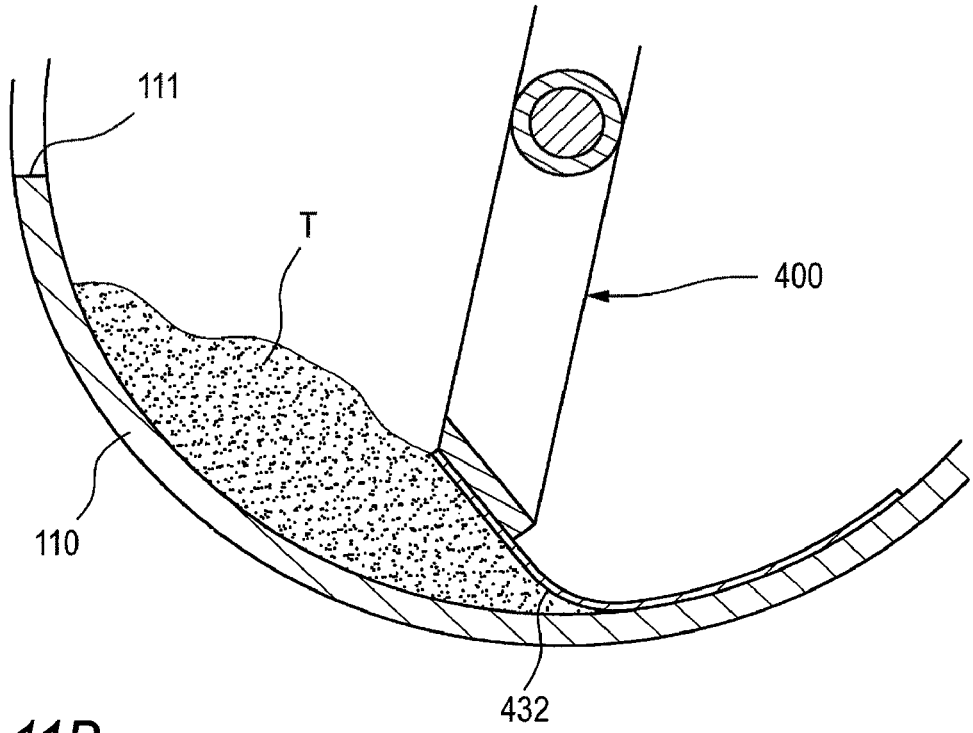
Figure 11B:
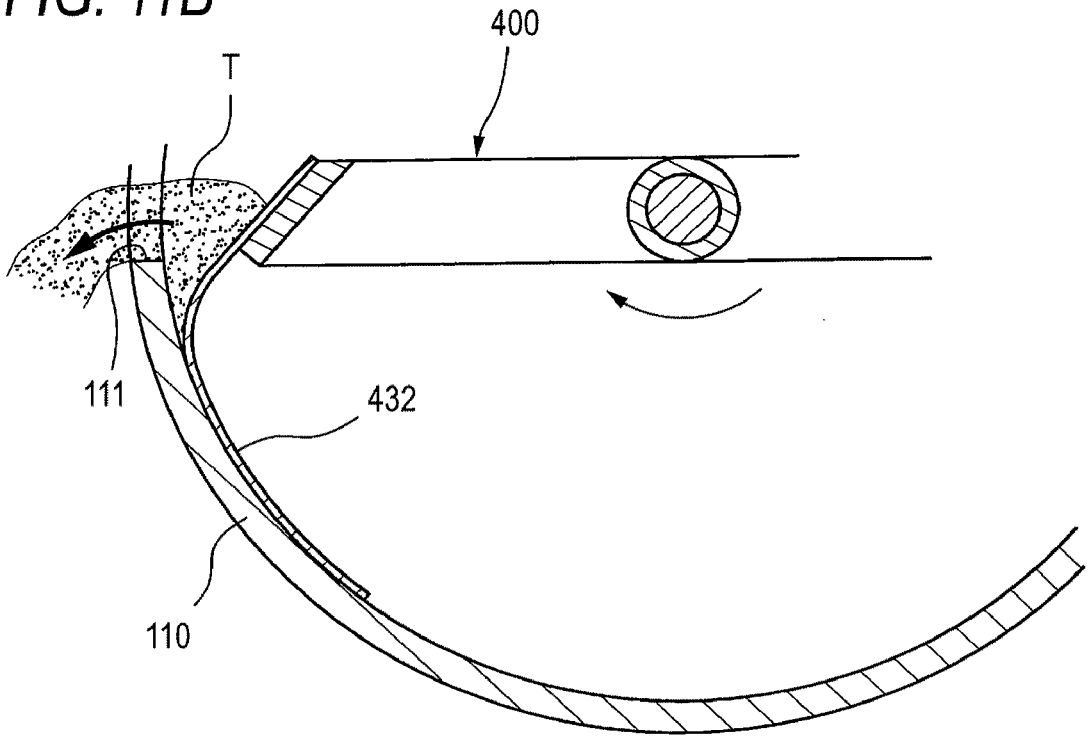

For this reason, as shown in FIGS. 11A and 11B, the delivery agitation blade 432 can push up the developer T accumulated in the lower half portion of the inside housing 110 to the supply opening 111 so that the developer T is efficiently discharged through the supply opening 111 to the developing chamber 28A. Moreover, the oblique agitation blades 422 of the oblique agitation blade unit 420 pass through the return openings 112 from the above to the below in a manner similar to the oblique agitation blades 230 according to the first example (see FIGS. 7A to 7D) in order to return the developer T through the return openings 112 efficiently.

According to the second example, following advantages can be provided.

Since the oblique agitation blades 422 are rotated so that they pass through the return openings 112 from the above to the below, it is possible to efficiently return the developer T through the return openings 112 to the inside of the inside housing 110. Accordingly, circulation of the developer T can be improved.

Since the delivery agitation blade 432 is rotated so that it passes the supply opening 111 from the below to the above, the developer T accumulated in the lower half portion of the inside housing 110 can be efficiently discharged through the supply opening 111.

Since the rotation direction of the driving force transmitted to the delivery agitation blade 432 is reversed via the gear mechanism 440 having such a simple structure as to be received into the inside housing 110, it is possible to miniaturize the developer cartridge 100 and to realize the miniaturization of the image forming apparatus 1.

Since the first gear 441, the second gear 442 and the third gear 443 are configured to make point contact with each other in order to transmit power, it is possible to prevent the developer T from being entangled between the gears 441, 442 and 443, whereby the delivery agitation blade 432 can be efficiently rotated in a direction opposite to the rotation direction of the oblique agitation blades 422.

Since the third gear 443 is provided above the rotation shaft 410, the portions of the third gear 443 engaging with the first gear 441 and the portions of the third gear 443 engaging with the second gear 442 can be isolated from the developer T accumulated in the lower half portion of the inside housing 110. For this reason, it is possible to more efficiently prevent the developer T from being entangled between the gears 441, 442 and 443. Moreover, since the third gear 443 is not buried in the developer T accumulated in the lower half portion of the inside housing 110, the flow of the developer T in the inside housing 110 is not interfered. Accordingly, circulation of the developer T can be improved.

Since the gear mechanism 440 is disposed between the delivery agitation blade unit 430 and the second oblique agitation blade unit 420B that is disposed at a side to which the driving force of the rotation shaft 410 is transmitted, it is possible to prevent distortion of the rotation shaft 410.

Although the present invention has been described based on the above-described exemplary embodiments, the present invention is not limited to the above-described exemplary embodiments. It will be understood that the present inventive concept may be subjected to various improvements and modifications within the scope of the present invention.

Figure 12:
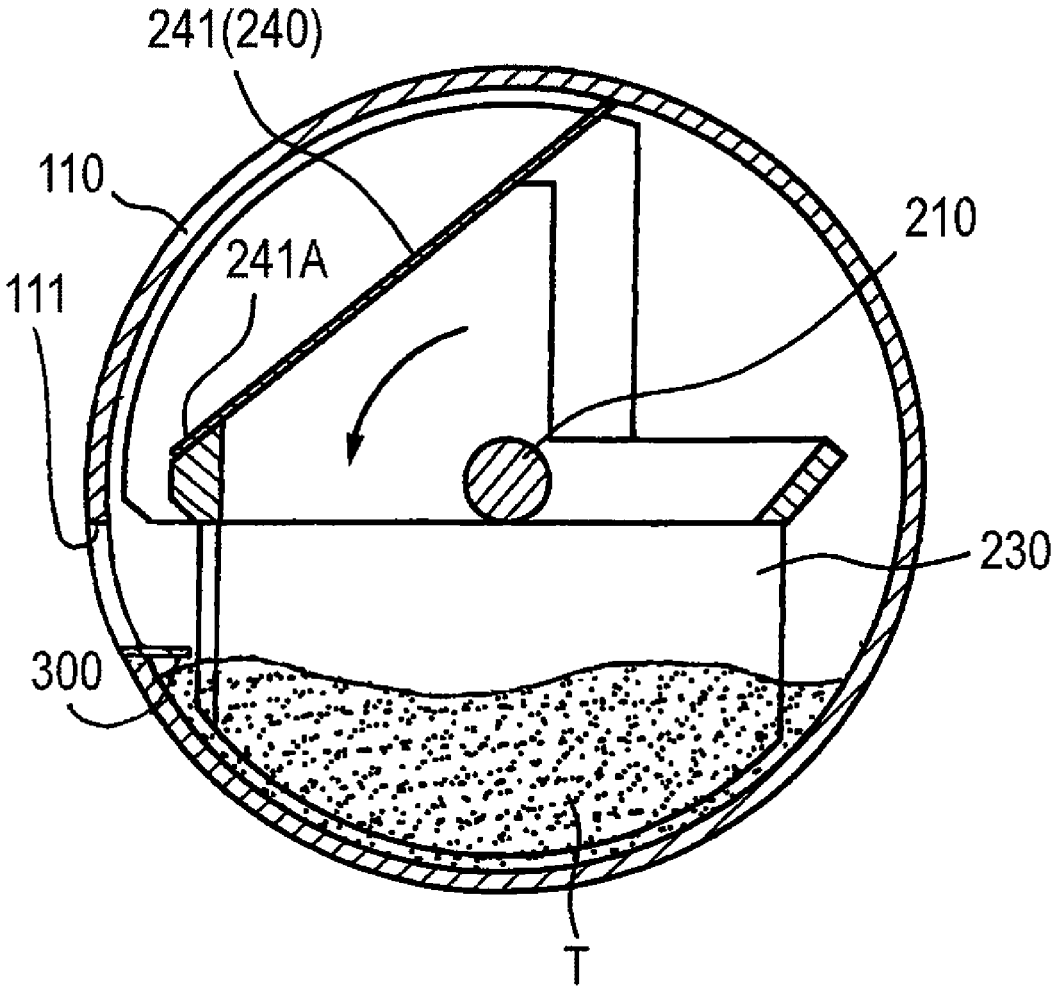
FIG. 12 is a sectional view showing a modified example of the inside housing.

In the first example, the supply opening 111 of the inside housing 110 is disposed at a position overlapping with the rotation shaft 210 in the horizontal direction (see FIGS. 6A to 6D). Alternatively, the supply opening 111 may be provided below the rotation shaft as shown in FIG. 12. According thereto, the developer T can more efficiently slip off from the plate-shaped portion 241 of the delivery agitation blade 240.

In the first example, the pair of guide walls 242 of the delivery agitation blade 240 is arranged in parallel. Alternatively, the gap between the pair of guide walls may be gradually decreased as they go toward the return opening side of the inside housing. According thereto, the developer can be more efficiently flown into the supply opening.

In the second example, although the gear mechanism 440 is used as the driving unit, the present invention is not limited to this. For example, the driving unit may have a structure in which the first gear 441 is detached from the gear mechanism 440 shown in FIG. 8, the upper end of the gear holding member 444 protrudes out to the outside of the developer cartridge, and a driving force of which the direction is opposite to the direction of the driving force transmitted to the rotation shaft 410 is transmitted to the upper end of the gear holding member 444.

In the above-described exemplary embodiments, although the present inventive concept have been described in relation to a laser printer, the present inventive concept is not limited to any specific type of laser printer. Rather, the present inventive concept can be applied to other image forming apparatuses such as a copying machine or a multi-functional device.

Further, in the above-described exemplary embodiments, the scanner unit 16 is employed as the exposure unit. Alternatively, an LED head may be used for example. Moreover, the structure of the conveying unit or the fixing unit may be appropriately modified.

Still further, in the above-described exemplary embodiments, although a single supply opening 111 (121) and two return openings 112 (122) are provided, the number of ports can be arbitrary. For example, one supply opening may be provided at one end side of the developer cartridge and one return opening may be provided at the other end side of the developer cartridge.

Still further, in the above-described exemplary embodiments, the oblique agitation blades 230 and 422 formed of material such as resin that is not likely to bend are used as the first agitation blade. Alternatively, flexible sheet may be used for the oblique agitation blades 230 and 422. Further, in the first example, the delivery agitation blade 240 formed of material such as resin that is not likely to bend is used as the second agitation blade. Alternatively, the flexible sheet may be used for the second agitation blade. Still further, in the second example, the delivery agitation blade 432 formed of flexible sheet is used as the second agitation blade. Alternatively, the delivery agitation blade may be formed of material such as resin that is not likely to bend or non-flexible material. In such a case, a distal end of the delivery agitation blade may be slightly separated from the inner surface of the inside housing without sliding contact with the inside housing.

In the first example, although a plurality of openings 225 is formed on the entire surface of the support wall 220, the openings may be formed in a portion of the support wall, or the openings may not be formed. Moreover, although the rectangular support frames 421 and 431 having a rectangular opening at the center thereof are used in the second example, the openings formed by the support frames 421 and 431 may be appropriately covered by a plate-shaped member.

In the second example, the delivery agitation blade unit 430 is inserted into the rotation shaft 410 in the axial direction from one end thereof. Alternatively, the delivery agitation blade unit 430 (specifically, the C-shaped shaft portion 433) may be fitted to the rotation shaft 410 by being pressed in the diameter direction of the rotation shaft 410.

What is claimed is:

1. A developer cartridge comprising:

a housing configured to accommodate developer;

a rotation shaft that is rotatably supported by the housing and passes across an inside of the housing;

a supply opening that is formed in a wall of the housing opposite the rotation shaft in a diameter direction and is configured to supply the developer to an outside of the housing;

a return opening that is formed in a wall of the housing at a position displaced from the supply opening in an axial direction of the rotation shaft and is configured to return the developer to the inside of the housing;

a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to pass through the position opposite the return opening from above to below the position opposite the return opening, the position opposite the return opening being between the return opening and the rotation shaft.

2. The developer cartridge according to claim 1, wherein the second agitation blade is rotatable in the opposite direction from the first agitation blade, and wherein the developer cartridge further comprises a driving unit configured to rotate the first agitation blade in a direction opposite to a rotational direction of the second agitation blade.

3. The developer cartridge according to claim 2, wherein the driving unit comprises:

a first gear rotatable integrally with the first agitation blade;

a second gear rotatable integrally with the second agitation blade; and a third gear that is rotatable in a circumferential direction perpendicular to the rotation shaft and engageable with the first gear and the second gear.

4. The developer cartridge according to claim 3, wherein the first gear, the second gear and the third gear are point contactable with each other.

5. The developer cartridge according to claim 4, wherein the third gear is provided above the rotation shaft.

6. The developer cartridge according to claim 3, wherein the third gear is configured to transmit driving force input from the first gear to the second gear by reversing a direction of the driving force.

7. The developer cartridge according to claim 3, further comprising:

two return openings at both sides of the supply opening; and two first agitation blades at both sides of the second agitation blade corresponding to positions opposite to the two return openings, wherein the two first agitation blades are rotatably supported by the rotation shaft, the two first agitation blades being integrally rotatable, wherein the second agitation blade is rotatably supported by the rotation shaft, wherein driving force is transmitted to the rotation shaft from one end side of the rotation shaft, and wherein the driving unit is provided between one of the two first agitation blades at the one end side of the rotation shaft and the second agitation blade.

8. The developer cartridge according to claim 1, wherein the first agitation blade and the second agitation blade are rotatable in a same direction, and wherein the second agitation blade comprises a plate-shaped portion, wherein the plate-shaped portion comprises a first end at a forward side in a rotation direction thereof and a second end at a backward side in the rotation direction thereof, the plate-shaped portion being inclined such that the second end is positioned above the first end when the first end is positioned at a lower end of the supply opening.

9. The developer cartridge according to claim 8, wherein the plate-shaped portion comprises guide walls at both end portions thereof in the axial direction of the rotation shaft, the guide walls extending outwardly in the diameter direction of the rotation shaft.

10. The developer cartridge according to claim 8, further comprising a flexible film that is provided at the lower end of the supply opening and extends toward the rotation shaft.

11. The developer cartridge according to claim 8, wherein the supply opening is provided below the rotation shaft.

12. A developing device comprising:

a developer cartridge comprising:

a housing configured to accommodate developer;

a rotation shaft that is rotatably supported by the housing and passes across an inside of the housing;

a supply opening that is formed in a wall of the housing opposite the rotation shaft in a diameter direction and is configured to supply the developer to an outside of the housing;

a return opening that is formed in a wall of the housing at a position displaced from the supply opening in an axial direction of the rotation shaft and is configured to return the developer to the inside of the housing;

a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to pass through the position opposite the return opening from above to below the position opposite the return opening, the position opposite the return opening being between the return opening and the rotation shaft;

a developing chamber to which developer is supplied through the supply opening of the developer cartridge;

a supply roller provided in the developing chamber; and a developing roller to which the developer is supplied from the supply roller.

13. A process cartridge comprising:

a developing device comprising:

a developer cartridge comprising:

a housing configured to accommodate developer;

a rotation shaft that is rotatably supported by the housing and passes across an inside of the housing;

a supply opening that is formed in a wall of the housing opposite the rotation shaft in a diameter direction and is configured to supply the developer to an outside of the housing;

a return opening that is formed in a wall of the housing at a position displaced from the supply opening in an axial direction of the rotation shaft and is configured to return the developer to the inside of the housing;

a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to pass through the position opposite the return opening from above to below the position opposite the return opening, the position opposite the return opening being between the return opening and the rotation shaft;

a developing chamber to which developer is supplied through the supply opening of the developer cartridge;

a supply roller provided in the developing chamber; and a developing roller to which the developer is supplied from the supply roller; and a photosensitive drum to which the developer is supplied from the developing roller.

* * * * *